United States Patent [19]

Link et al.

[11] 4,435,690

[45] Mar. 6, 1984

[54] PRIMARY CIRCUIT BREAKER

[75] Inventors: Edwin A. Link, Waukesha; Harvey W. Mikulecky, Oconomowoc, both of Wis.

[73] Assignee: RTE Corporation, Waukesha, Wis.

[21] Appl. No.: 371,776

[22] Filed: Apr. 26, 1982

[51] Int. Cl.[3] ..... H01H 75/12

[52] U.S. Cl. ..... 335/37; 337/75; 361/37

[58] Field of Search ..... 335/37, 38, 21, 171, 335/173, 189, 190; 361/37; 337/75

[56] References Cited

U.S. PATENT DOCUMENTS 3,983,454 9/1976 Cotton et al. ..... 361/37

4,053,938 10/1977 Estes ..... 361/37

*Primary Examiner*—Harold Broome

[57] ABSTRACT

A primary circuit breaker for fluid filled transformers, the circuit breaker being immersible in the fluid in the transformer and including a circuit interrupter assembly, an externally actuatable latch mechanism for reclosing the interrupter assembly and a magnetically controlled trip assembly for releasing the interrupter assembly from the latch mechanism in response to predetermined electrical and thermal conditions in the transformer.

16 Claims, 10 Drawing Figures

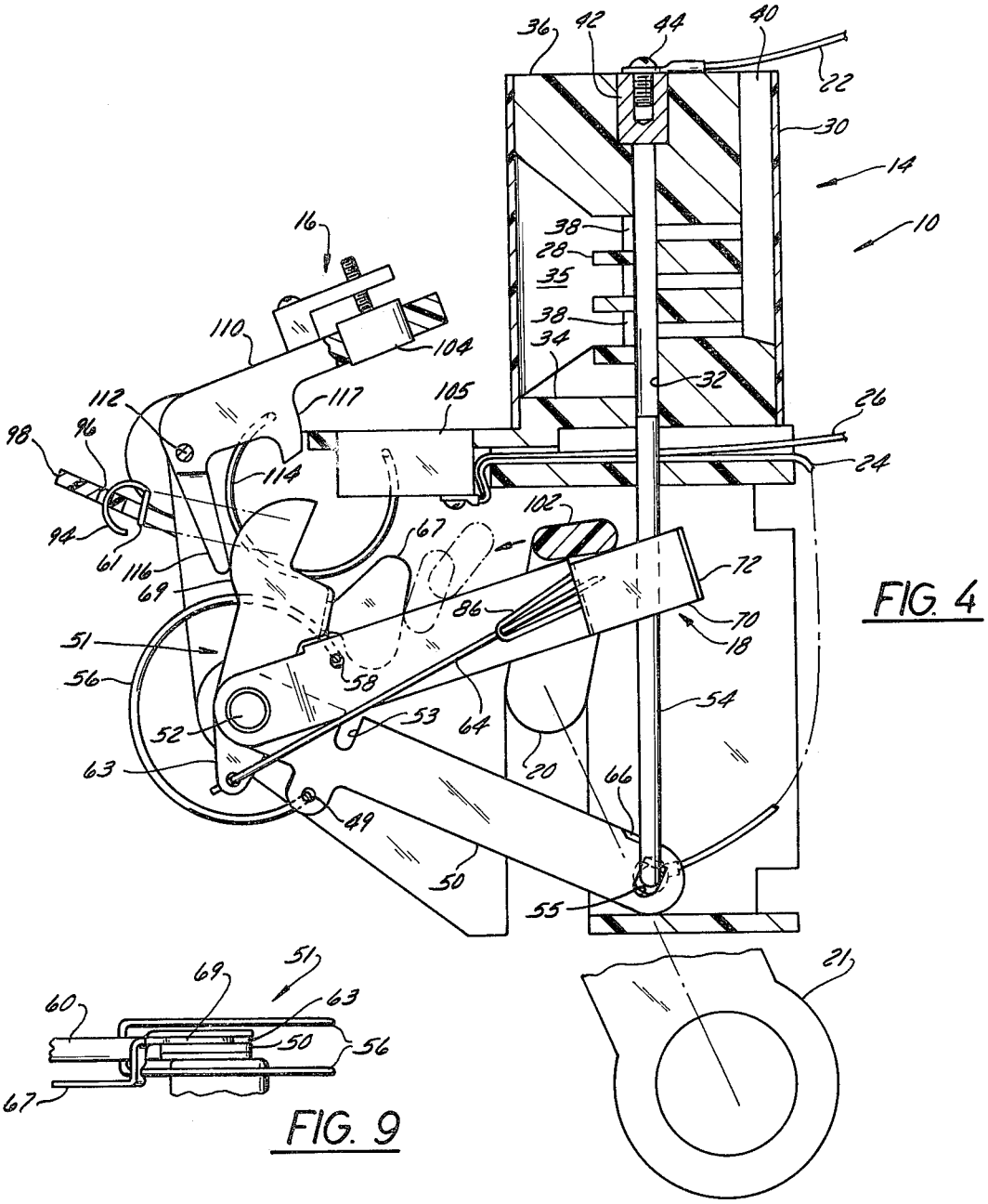
FIG. 4
FIG. 9
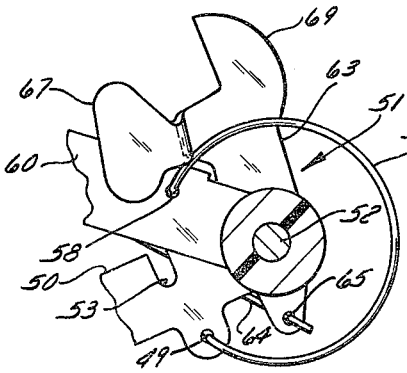
FIG. 8

PRIMARY CIRCUIT BREAKER

BACKGROUND OF THE INVENTION

Distribution transformers have conventionally been protected from fault currents by load sensing fuses provided on the primary winding. An externally operable primary switch combined with a temperature sensing wax motor is disclosed in U.S. Pat. No. 4,053,938 issued on Oct. 11, 1977 entitled Temperature Sensing Transformer Primary Switch which is assigned to the same assignee as the present application. In this system, a wax motor senses the temperature of the insulating fluid and on reaching the melt temperature, opens the primary switch. The wax motor only sensed extended overloads, and could only interrupt load type currents, not fault currents. Load sensing fuses must be replaced on fusing before the transformer can be put back on line.

SUMMARY OF THE INVENTION

In the present application, an externally operable resetable circuit breaker is provided which can be placed in the primary circuit to respond to both fault currents and overload conditions and can be reset when those conditions have been corrected. The circuit breaker is tripped by a temperature sensing device which is responsive to an increase in temperature due to fault current in the primary winding as well as an increase in temperature of the insulating oil due to loading or incipient faults.

IN THE DRAWINGS

FIG. 4 is a section view similar to FIG. 2 showing the latch mechanism in the magnetic trip position.

FIG. 8 is a section view of a portion of the trip release mechanism taken from the back of FIG. 4.

FIG. 9 is a top view of FIG. 8.

DESCRIPTION OF THE INVENTION

Figure 1:
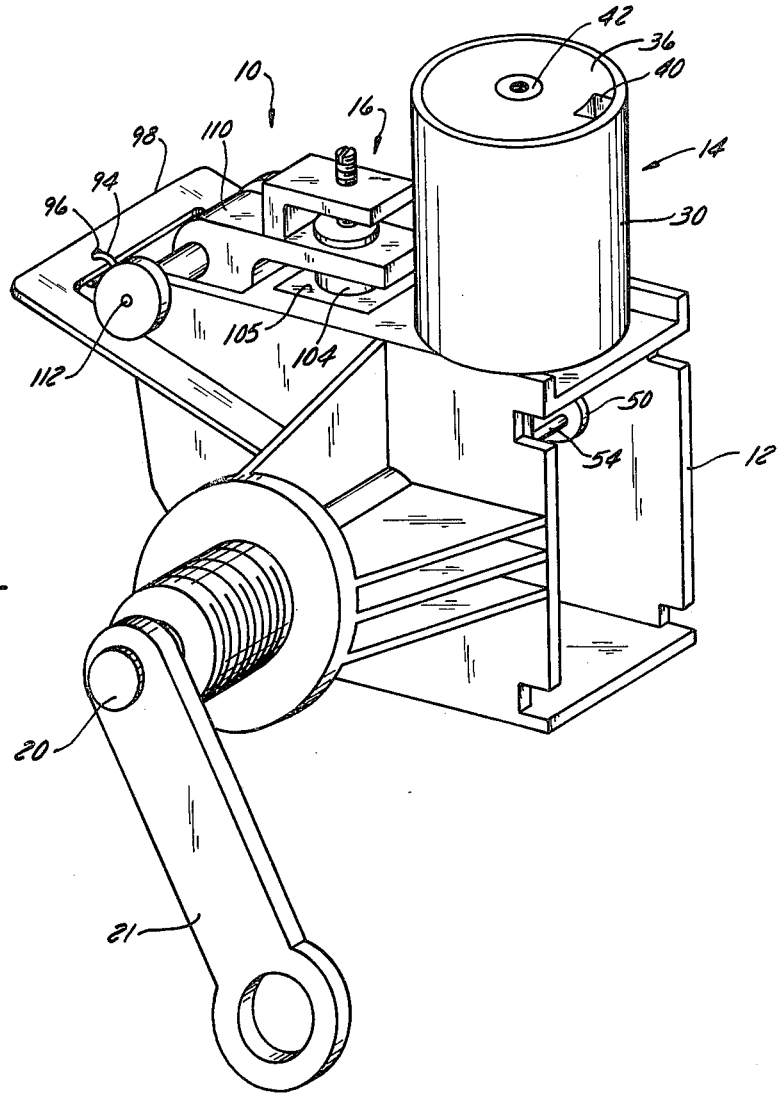
FIG. 1 is a perspective view of the circuit breaker according to the present invention.
Figure 7:
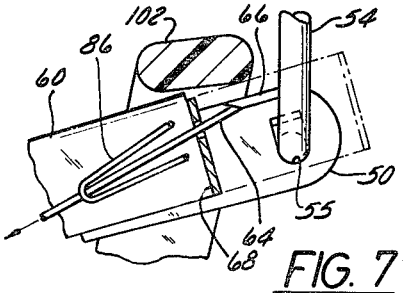
FIG. 7 is an enlarged view of a portion of the trip release assembly shown in FIG. 2.

The primary circuit breaker 10 of the present invention as seen in the drawings generally includes a frame or base 12, an arc extinguishing assembly 14, a temperature responsive trip assembly 16 and a latch mechanism 18. The latch mechanism 18 can be used to manually open and close the circuit breaker externally of the transformer. In this regard, the latch mechanism is actuated by means of a crank shaft 20 having an actuating handle 21 located externally of the transformer tank.

The circuit breaker 10 is immersed in the insulating fluid in the transformer tank and connected in series with the primary circuit 22 of the transformer. The electrical circuit through the circuit breaker generally follows a path through the arc extinguishing assembly 14 to a line 24 to the temperature sensing assembly 16 and to the transformer through a line 26. The temperature responsive assembly 16 thus responds to fault current which passes through the lines 24 and 26 and also responds to the temperature of the insulating fluid to open the circuit breaker.

ARC EXTINGUISHING ASSEMBLY

The arc extinguishing assembly 14 is mounted on the frame 12 and includes a central core 28 formed of an arc extinguishing material such as a polyester which is enclosed within a glass reinforced epoxy sleeve 30. The core 28 includes a bore 32 with a circular base 34 at the bottom and a circular cap 36 of the same diameter at the top. The base 34 and cap 36 are formed as integral parts of the core 28. The space between the base 34 and the cap 36 defines an arc chamber 35 which is open to the bore 32 through openings 38 in the core 28 so that gases created by the heat of the arc on interruption or opening of the contacts can expand into the arc chamber 35. The expanding gases are confined in the arc chamber 35 by means of the sleeve 30. A relief port 40 is provided on the periphery of the cap 36 to allow for the restricted discharge of oil and/or gases from the arc chamber on interruption and to allow for the ingress of insulating fluid into the arc chamber when the circuit breaker is immersed in the insulating fluid in the transformer. All of the axial forces of the expanding gases are confined to the space between the base 34 and the cap 36. The sleeve 30 is therefore designed to resist only the radial forces acting against the inside surface of the sleeve. This is contrary to conventional type arc chambers which are formed inside of hollow cylindrical tubes that require special caps or covers which must be capable of resisting both radial and axial forces.

The upper end of the bore 32 is closed by means of a conductive contact 42 provided in the top of the cap 36. The contact 42 is connected to the primary circuit 22 by means of a screw 44. The primary circuit 22 is opened and closed by means of a conductive rod 54 mounted for reciprocal motion in the bore 32.

THE LATCH MECHANISM

Referring to FIGS. 3, 4, 6 or 7, the circuit breaker 10 is opened and closed by moving the conductive rod 54 into and out of engagement with contact 42 by means of the latch mechanism 18. In this regard, the latch mechanism 18 includes a first lever arm 50, a second lever arm 60 and a trip assembly 51. The first lever arm 50 is normally latched or locked to the second lever arm 60 to manually open and close the circuit breaker and is released from the lever arm 60 by means of the trip assembly 51 to open the circuit breaker under a fault condition. More particularly, the first lever arm 50 is pivotally mounted at one end on a pivot pin 52 provided in the frame 12. Means are provided at the other end of the arm 50 to connect the conductive rod 54 to the lever arm 50. Such means is in the form of an opening 55. Pivotable movement of the lever arm 50 will move the rod 54 axially in the bore 32 into and out of engagement with the contact 42. The lever arm 50 is provided with an opening 49, slot 53 and a flange 66.

The second lever arm 60 is pivotally mounted on the pin 52 and is bent in the form of a U to provide a slot 62 to straddle the lever arm 50. The lever arm 50 is held in the slot 62 by means of a rod 64 which is moveable into engagement with the flange 66 provided on the lever arm 50. It should be noted that the lever arm 60, FIG.

3, is also bent at a right angle to form an extension 68 which is bent at a second right angle to form a stop arm 70. The end 72 of stop arm 70 is bent at a right angle to form a limit stop to the downward motion of arm 60. The extension 68, FIG. 6, includes a guide slot 76 for the rod 64, a spring slot 78, a pair of notches 80 and a main spring opening 82.

The trip assembly 51 includes a trip lever 63 mounted for pivotal motion on pin 52 and the rod 64. As seen in FIGS. 8 and 9, the trip lever 63 includes an opening 65 at one end, a first cam 67 and a second cam 69 at the other end. The rod 64 has one end bent to enter the opening 65 in lever 63. The other end of the rod 64 extends through the slot 76 to a position to engage the flange 66 on the arm 50. The rod 64 is biased by means of a spring 86 toward the flange 66. In this regard it will be noted that the ends 88 of spring 86 (FIG. 6) are bent to pass through the slot 78 and overlap the notches 80. The rod 64 is pulled out from the flange 66 on rotation of the trip lever 63 clockwise and pushed toward the flange on rotation of the trip lever 63 counter-clockwise.

The lever arms 50 and 60 are normally biased in opposite directions by a first means in the form of a spring 56. The spring 56 is anchored in the opening 49 provided in the lever arm 50 and in the opening 58 provided in the arm 60. The slot 53 in the arm 50 provides clearance for the end of the spring 56 anchored in the opening 58. It should be noted that the lever arms 50 and 60 will move as a unit when the rod 64 is moved to a position to engage the flange 66. On disengagement of the rod 64 from the flange 66, the lever arm 50 will rotate away from lever arm 60, pulling the conductive rod 54 away from contact 42 (FIG. 4).

Once the circuit breaker has been tripped to the open position as seen in FIG. 4, the lever arm 60 has to be rotated clockwise into alignment with the lever arm 50 in order to reset the trip mechanism. This is accomplished by a second means in the form of an overcenter spring mechanism 61 which is moved between the upper position shown in FIG. 4 and the lower position shown in FIG. 5 by means of the crank shaft 20.

Referring to FIGS. 2 through 5, the overcenter spring 61 has one end 92 connected to the opening 82 in the extension 68 to the lever arm 60 and the other end 94 connected to an opening 96 in a yoke 98. The yoke 98 is mounted on the crank shaft 20 which is rotated manually by means of the external handle 21. The yoke 98 is rotated counterclockwise from the circuit breaker open position shown in FIG. 5 to the circuit breaker closed position shown in FIG. 4. As the spring 61 is rotated past the pivot axis of the pin 52, the bias force of the spring 61 on the lever arm 60 is reversed. As the spring 61 moves overcenter, the arm 60 will snap either upward or downward.

Means are provided to assure the engagement of the rod 64 with the flange 66 when the lever arm 60 is snapped to the down position. Such means is in the form of the eccentric section 102 of the crank shaft 20. The eccentric section 102 is rotated manually toward the cam 67 provided on the trip lever 63 as seen in FIG. 4. The section 102 engages the cam 67 on trip lever 63 to rotate the trip lever 63 counterclockwise on pin 52. The motion of the trip lever 63 pushes the rod 64 toward the flange 66.

Figure 5:
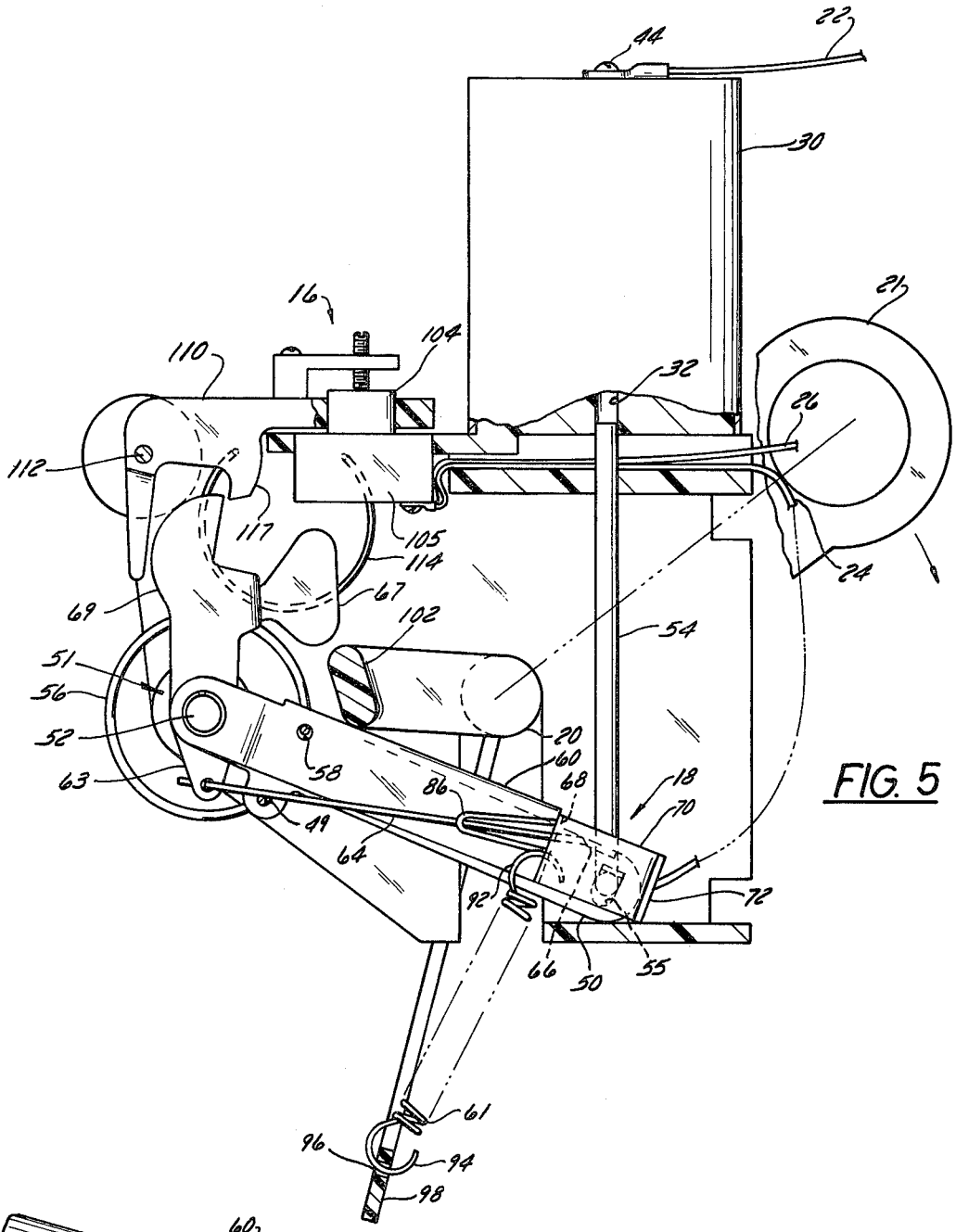
FIG. 5 is a section view of the circuit breaker showing the latch mechanism in the manual trip position.
Figure 6:
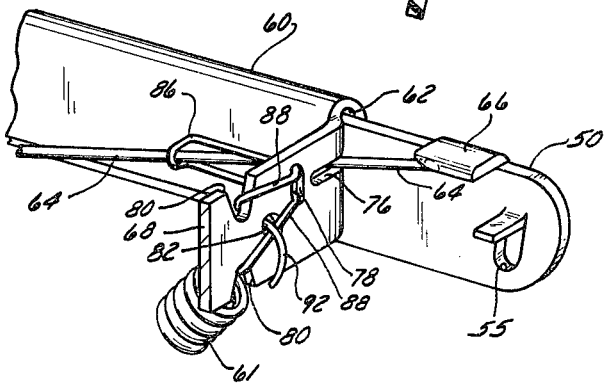
FIG. 6 is a perspective view of a portion of the latch mechanism showing the trip release assembly.

Referring to FIG. 5, the lever arm 60 is shown snapped downward over lever arm 50. Continued rotation of the section 102 as seen in FIG. 5 will move the end of the rod 64 to a position below the flange 66. To assure that the rod 64 moves under the flange 66 when the lever arm 60 is snapped down by the spring 90, the crank shaft 20 is rotated far enough to move the section 102 against the lever 60. The rod 64 is biased by means of the spring 86 laterally toward the flange 66. When the crank section 102 is rotated against lever arm 60, the rod 64 will be moved below the flange 66 allowing the spring 86 to bias the rod 64 against the side of lever arm 60.

Figure 2:
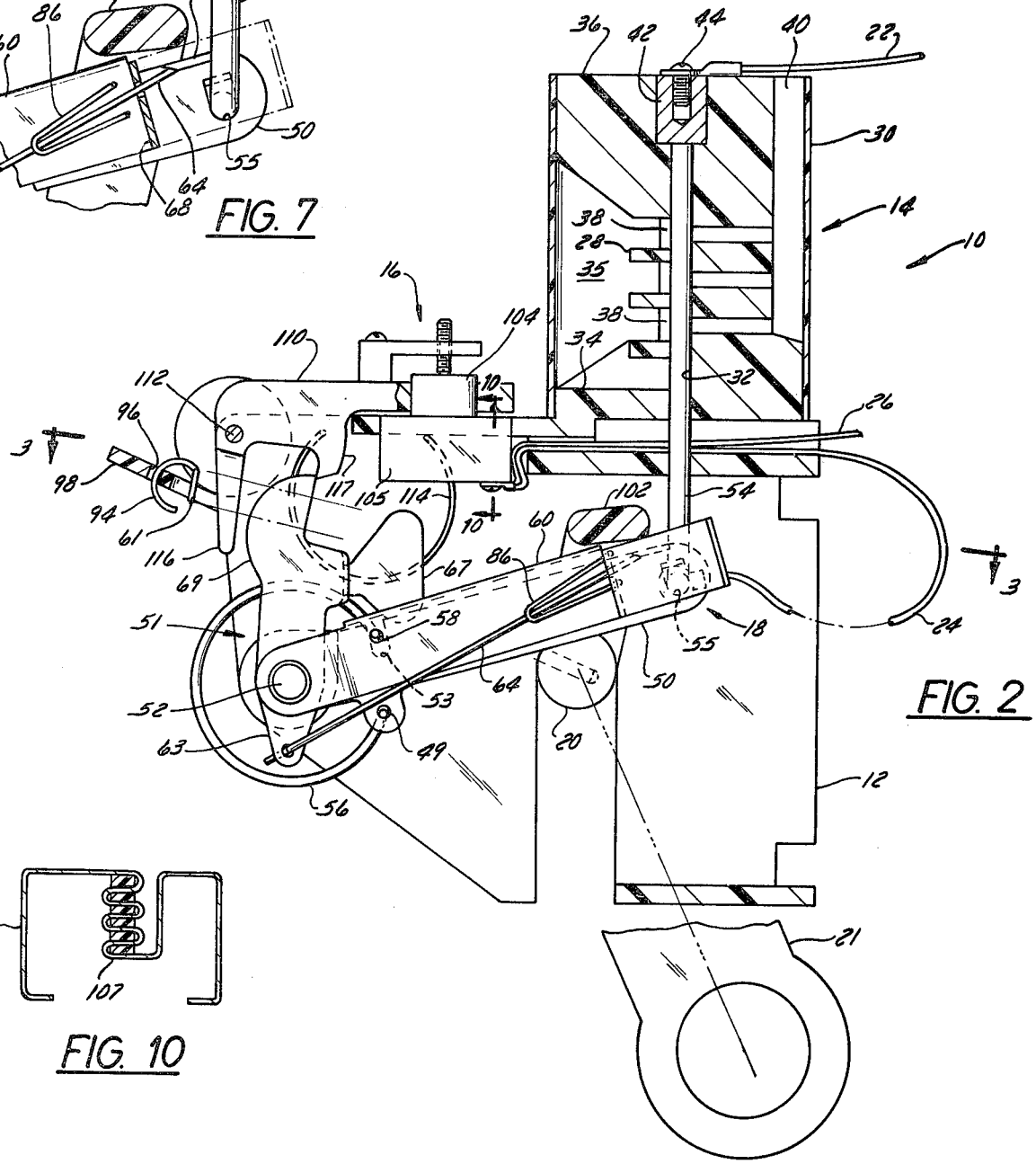
FIG. 2 is a section view in elevation showing the latch mechanism in the circuit closed position.

To reset the circuit breaker, the crank shaft 20 is rotated clockwise (FIG. 2). On rotation of the crank shaft 20 clockwise, the yoke 98 will be returned to the position shown in FIG. 2 reversing the bias of spring 61 on the lever arm 60 causing it to rotate counterclockwise. Since the rod 64 is now engaged with the flange 66, the lever arm 50 will follow the upward motion of the lever arm 60. The motion of the lever arm 50 will move the rod 54 upward in the bore 32 in the core 28 into engagement with the contact 42 to close the circuit.

TEMPERATURE SENSING ASSEMBLY

In the present embodiment of the invention, tripping of the circuit breaker is controlled by means of the temperature sensing assembly 16. This is accomplished by means of the magnetic force of a magnet 104. In this regard, it is known that as the curie temperature of a material is approached, the magnetic properties of the material will be reduced resulting in a loss of attraction to the magnet. The metal element 105 of the present invention is immersed in the insulating fluid of the transformer and operatively positioned to sense the heat of a fault current on the primary of the transformer. The element will thus respond to both the temperature of the fluid as well as the temperature of a fault current on the primary side of the transformer.

Figure 10:
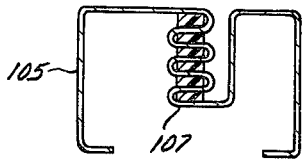
FIG. 10 is a section view taken on line 10—10 of FIG. 2 showing the coil forward in its metalic plate.
Figure 3:
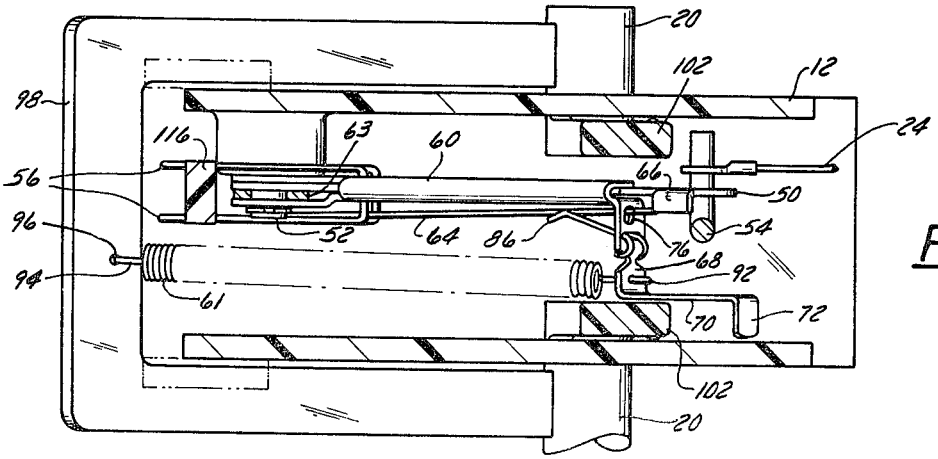
FIG. 3 is a view taken generally along line 3—3 of FIG. 2.

Referring to FIGS. 2, 4, and 5, the trip assembly 16 includes a bell crank 110 pivotally mounted on a pin 112 in the frame 12. The magnet 104 is mounted on one end of the bell crank in a position to engage the metal element 105. The element 105 (FIG. 10) is bent to form a folded coil 107 with electrical insulation provided between the folds. The coil metal element 105 is connected in series with the primary lines 24 and 26.

Under normal load, the resistance of the folded coil 10 will increase the temperature of element 105 slightly. Under fault conditions an immediate temperature rise will occur in the folded coil 107. The bell crank 110 is provided with an actuating end 116 and a latch member 117. The bell crank 110 is biased by means of a spring 114 in a counterclockwise direction. The rotary motion of the bell crank 110 will disengage the latch member 117 from the cam 69 and will, then move the end 116 of the bell crank into engagement with the cam 69 of the trip lever 63. Continued rotation of the bell crank 110 will rotate the trip lever 63 clockwise pulling the rod 64 away from the lever arm 50.

The bell crank 110 is prevented from rotating due to the bias of spring 114 by means of the magnet 104. The magnetic force of the magnet will hold the magnet against the element 105. In the event of a fault in the primary of the transformer, the temperature of the folded coil 107 will increase the temperature of the element 105 in relation to the fault current. The resistance of the folded coil 107 will produce an immediate rise in the temperature of the element 105. As the element temperature approaches the curie temperature, the magnetic holding force of the magnet will be reduced, thereby reducing the magnetic attraction of the magnet to the element and allowing the bell crank to rotate due to the bias of the spring 114. Obviously, the same condition will occur if the insulating fluid temperature reaches the curie temperature of the element.

The temperature sensing assembly 16 is reset on the counterclock wise rotation of the crank shaft 20 as seen in FIGS. 4 and 5. The eccentric section 102 of the crank shaft 20 will engage the cam 67 to rotate the trip lever 63 counterclockwise. The cam 69 of the trip lever 63 will engage the end 116 of the bell crank 110 rotating the bell crank 110 clockwise. As the magnet 104 is moved into close proximity to the element 105, the magnetic force of the magnet 104 will provide the final movement in resetting the temperature responsive assembly.

Although a magnet and a low curie temperature element has been described herein as the heat responsive means, it is within the contemplation of this invention to use other heat responsive devices such as a bimetal or a heat expandable device to rotate the trip lever 63. Any heat responsive device that provides a positive mechanical motion can be used as the means to release the trip assembly.

What is claimed is:

1. In a fluid distribution transformer, a circuit breaker connected in series with the primary winding of the transformer and adapted to be immersed in the transformer dielectric fluid, said breaker including a frame, a housing mounted on said frame and including a fixed contact, a movable contact mounted on said frame for movement into said housing to engage said fixed contact, first means for biasing said movable contact away from said fixed contact, second means for biasing said movable contact toward said fixed contact, latch means connecting said second biasing means to said first biasing means whereby said contact is held in engagement with said fixed contact by said second biasing means and temperature controlled trip means mounted on said frame in a position to disengage said latch means from said first biasing means when predetermined electrical and temperature conditions exist in the transformer whereby said first biasing means will be released from said second biasing means allowing said first biasing means to move the movable contact away from the fixed contact to open the circuit breaker.

2. The circuit breaker according to claim 1 wherein said housing includes arc extinguishing means for extinguishing the arc produced on disengagement of the movable contact from said fixed contact.

3. The circuit breaker according to claim 1 wherein said temperature responsive means includes an element having a predetermined curie temperature connected in series with said contacts, and a magnet mounted for movement into engagement with said element and retained in engagement therewith by the magnetic force of the magnet and means for biasing said magnet away from said element whereby said biasing means will move the magnet away from the element when the curie temperature of the element reduces the attraction force of the magnet below the bias force of the biasing means.

4. The circuit breaker according to claim 1 wherein said temperature responsive means comprises a bimetal connected in series with said contacts.

5. The circuit breaker according to claim 1 wherein said temperature responsive means comprises a heat expandable member.

6. A primary circuit breaker comprising a base, a first fixed contact and a second movable contact mounted on said base, means for moving said second contact into and out of engagement with said first contact, means connected to said moving means for biasing said second contact away from said first contact, manually actuatable means for selectively biasing said second contact into and out of engagement with said first contact, latch means for connecting said manually actuatable means to said moving means, heat responsive means mounted on said base for tripping said latch means to release said moving means from said manually actuatable means, said heat responsive means being responsive to primary and secondary load conditions whereby said second contact will be disengaged from said first contact when the predetermined conditions are present.

7. The circuit breaker according to claim 6 wherein said heat responsive means includes a magnet and an element having a predetermined curie temperature, said element being connected in series with one of said contacts, whereby a fault current imposed on said element will neutralize the magnetic force of said magnet when the temperature of said element approaches the curie temperature of said element.

8. The circuit breaker according to claim 6 wherein said heat responsive means includes a bimetal.

9. The circuit breaker according to claim 6 wherein said heat responsive means includes a heat expandable device.

10. A fluid immersible primary circuit breaker responsive to fault and overload conditions in a fluid filled electrical apparatus, said breaker comprising a frame adapted to be mounted in the fluid in the apparatus, a first contact mounted on said frame, a second contact mounted for movement into and out of engagement with said first contact, first means biasing said second contact away from said first contact, second biasing means manually movable between a first position for biasing said second contact into engagement with said first contact and a second position for biasing said second contact away from said first contact, means operably connecting said second biasing means to said first biasing means whereby said second contact responds to the position of said second biasing means, temperature responsive trip means for releasing said connecting means from said first biasing means in response to fault or overload conditions whereby said first biasing means will move said second contact away from said first contact.

11. The circuit breaker according to claim 10 wherein said temperature responsive trip means includes a magnet and a metallic element having a predetermined curie temperature.

12. The circuit breaker according to claim 10 wherein said temperature responsive means includes a bimetal.

13. The circuit breaker according to claims 10, 11 or 12 including an arc interrupting assembly mounted on said base for extinguishing the arc produced on moving said second contact away from said first contact.

14. The breaker according to claim 10 wherein said first biasing means includes a first lever arm having one end pivotally mounted on said frame and the other end operatively connected to said second contact, catch means on the other end of said first lever arm, said second means includes a second lever arm having one end pivotally mounted on said frame on the same pivot axis as said first lever arm, said operably connecting means includes a trip lever pivotally mounted on said base on the same pivot axis as said first and second lever arms and a rod member mounted on said second lever arm, one end of said rod member being connected to said trip lever whereby rotary motion of said trip lever moves said rod member longitudinally on said second lever arm into and out of engagement with said catch means, and said trip means includes a crank member biased for movement into engagement with said trip lever for moving said member away from said catch means.

15. The breaker according to claim 14 wherein said trip means includes a magnet mounted on said crank member for preventing said crank member from rotating into engagement with said trip lever.

16. The breaker according to claims 14 or 15 including an arc interruption assembly mounted on said base for extinguishing the arc produced on moving said second contact away from said first contact.

* * * * *